United States Patent [19]

Lee

[11] 4,255,955

[45] Mar. 17, 1981

[54] AUTOMATIC SAFETY MECHANISM FOR FORMING MACHINES

[75] Inventor: Shi C. Lee, Kaoshiung, Taiwan

[73] Assignee: Chunzu Machinery Industry Co., Ltd., Kaoshiung, Taiwan

[21] Appl. No.: 19,264

[22] Filed: Mar. 9, 1979

[51] Int. Cl.[3] ..... B21D 53/24; B21D 43/10; B21C 51/00

[52] U.S. Cl. ..... 72/31; 10/72 T; 10/76 T; 10/23; 72/405; 72/422; 408/7; 408/16; 408/710; 414/730

[58] Field of Search ..... 10/11 T, 12 T, 23, 72 T, 10/76 T, 166; 29/741; 72/419, 422, 426, 26, 31, 405; 83/66, 67; 340/568, 673, 679, 680; 408/7, 16, 710; 414/730

[56] References Cited

U.S. PATENT DOCUMENTS

| | | | |
|---|---|---|---|
| 2,100,028 | 11/1937 | Frayer | 10/12 T |
| 2,383,313 | 8/1945 | Hoffman et al. | 10/23 |
| 2,867,810 | 1/1959 | Gagnon | 29/741 X |

FOREIGN PATENT DOCUMENTS

| | | | |
|---|---|---|---|
| 422505 | 9/1974 | U.S.S.R. | 72/422 |
| 617257 | 7/1978 | U.S.S.R. | 414/730 |
| 647104 | 2/1979 | U.S.S.R. | 72/422 |

*Primary Examiner*—Ervin M. Combs

[57] ABSTRACT

The present invention relates to a safety mechanism for a multiphase forming machine, in which trigger signalling is used to automatically stop the machine by means of the insulation state formed between one leg of a clamp and a stock conveyor to which the clamp is attached as well as whether a nut stock is firmly held by the clamp so as to prevent any part of the machine from being damaged or destroyed.

4 Claims, 4 Drawing Figures

AUTOMATIC SAFETY MECHANISM FOR FORMING MACHINES

BACKGROUND OF THE INVENTION

This invention is concerned with a safety mechanism for a multiphase forming machine, in which one leg of the clamp attached to the stock conveyor is isolated against said conveyor, with the other attached directly to said conveyor, and when a nut stock is not correctly held between a clamp a trigger signal will be actuated to stop the machine so as to protect the machine body, the main slide, the punches, and the die from any damage.

In a conventional multiphase forming machine like a nut forming machine, a nut stock often slips out of the clamp as a result of any defect in the clamp or because the stock does not comply with specification. The nut stock is at times driven out of the die and then pulled back into the die because of a malfunctioning back punch, with other parts of the machines continuing to run so that the next nut stock is thrust upon the preceding one and the punches do not squarely strike upon the nut stock or only one punch strikes upon it, causing the breaking of the punches, the anvil or the die. The moment produced causes rotation of the main slide, resulting in serious damage or deformation. After the breaking a punch, the nut stock that has been sent by the clamp to the die at which the punch is aimed will be forced back into its original position so that no nut is produced. When the stock conveying system fails, the continuous running of the main slide will result in the punches striking at the clamp that stays near the die, causing harm to the punches, the clamp and even the conveyor system. In view of the above, the present safety mechanism is devised.

SUMMARY OF THE INVENTION

The primary object of this invention is to eliminate defects in a conventional forming machine and to provide an automatic safety mechanism to prevent the damage of the machine and the manufacture of defective products.

Another object of this invention is to provide an automatic safety mechanism that reduces labor requirements, boosts productivity and produces a trigger signal to automatically stop the machine when the machine does not function normally so that operators may make immediate checks and upkeep.

Other objects will become apparent from the following drawings and description.

DESCRIPTION OF THE PREFERRED EMBODIMENTS

Figure 1:
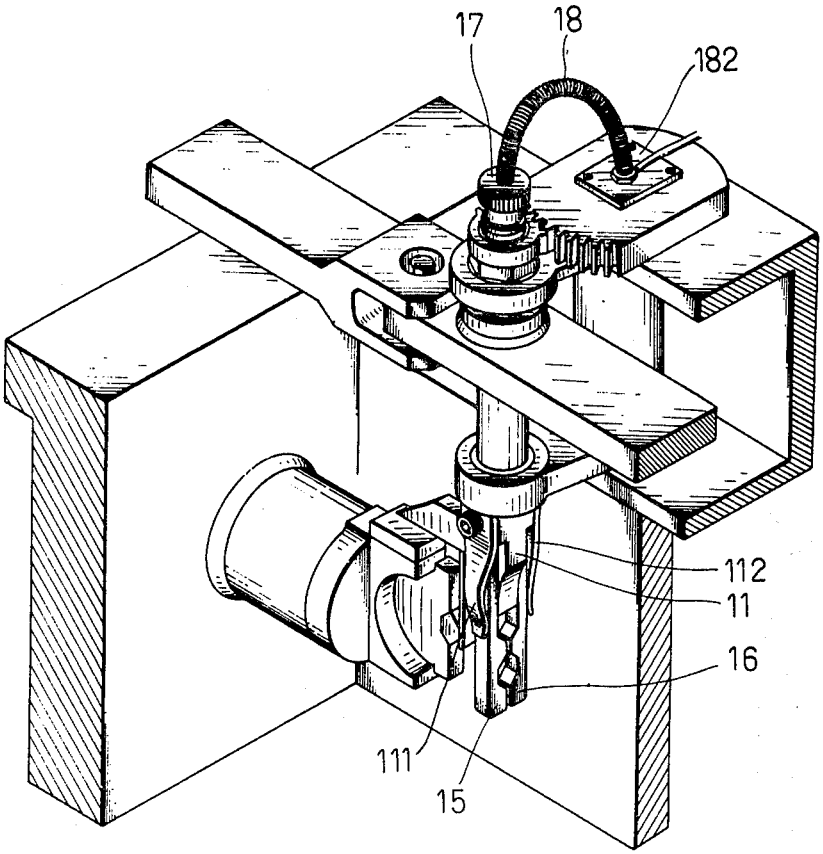
FIG. 1 is a perspective view of the stock conveyor system installed with the present invention.
Figure 2:
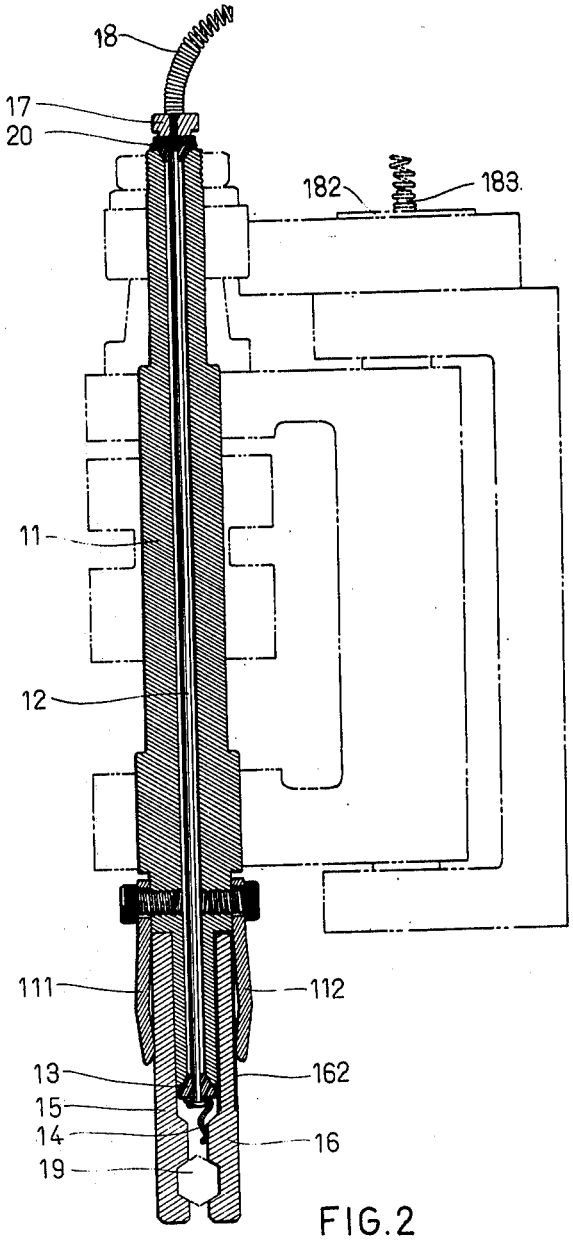
FIG. 2 is cross sectional view of the stock conveyor system installed with the present invention.
Figure 3:
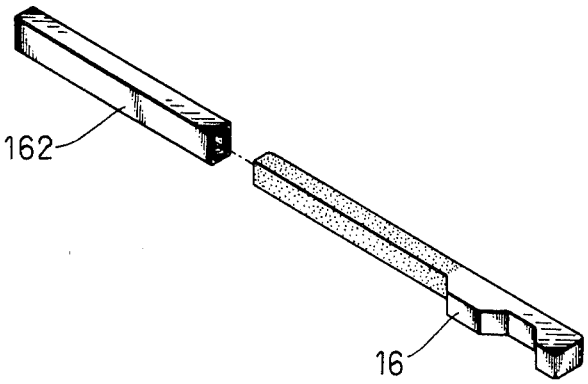
FIG. 3 is an exploded view of an insulated leg of the clamp in this invention.
Figure 4:
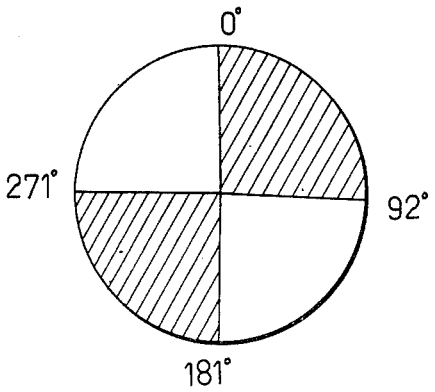
FIG. 4 is a view of the crank degree showing how the circuit is controlled.

With a nut-forming machine as an illustrative example, this invention is described in detail as follows:

The two legs 15, 16 of a clamp are attached to a nut-stock conveyor 11 with two elastic strips 111, 112, which in turn are fitted into said stock conveyor with bolts. The upper part of the clamp leg 16 is covered with insulating material like enamel and slipped into a pressure-resistant, protective casing 162 for contact with said conveyor 11 and elastic strip 112, while the lower half forms a circuit with a nut stock 19, held in the clamp, and a conductive spring 14. As insulated conductive rod on stick 12 pierces through conveyor 11 and conductive spring 14 is connected at one end with clamp leg 16 and at the other with conductive stick 12, riveted between said conductive stick and an insulated spacer 13. The upper end of said conductive stick 12 is fixed with a nut 17 onto an insulated spacer 20. Connected with said conductive stick is a flexible spiral wire made of phosphor bronze 18, whose other end connects with a conductive socket 183 fixed to an insulated fixture 182, which in turn is firmly attached onto the body of the machine. From said fixture 182 a wire transmits trigger signals to a control circuit.

In normal operation, the dead point, which is the point where the main slide or the punch is the farthest from the die, is taken as the point where the crank is at zero degrees. From 0° to around 92°, clockwise, is the stock conveying of the process when a nut stock is held between the clamp 15, 16 and voltage runs to the control circuit as a trigger signal through an electric current path connecting the machine body, clamp leg 15, nut stock 19, clamp leg 16, conductive spring 14, conductive stick 12 and spiral wire 18 permitting the machine to continue to run. From about 92° to 181° occurs the stage when punches make stocks into finished products as the nut stock grasped in the clamp is striken into the die by punches and slips from the clamp. As the conveyor returns to its original position, the crank rotates from about 181° to 271°, the clamp being empty and the circuit path between the body and the control circuit being open. In the stage from about 271° to 360°, the nut stock in the die is forced out of it into the clamp by the back punch. The control circuit functions only when the machine runs continuously.

During the conveying process from 0° to 92°, if the back punch fails to force the nut stock out of the die and into the clamp or if the nut stock slips off the clamp during the conveyance because of a defective or malfunctioning clamp, the control circuit receives no trigger signal and the machine automatically shuts off immediately, without returning to its original position. This prevent the over-lapping of nut stocks and the subsequent damage to said stocks in the forming process. Due to this safety mechanism the punches do not run the risk of being broken and the clamp will not be damaged when the punches strike the nut stock. There will not be any rotation of the main slide. In the stage from 180° to 271°, if the front punch breaks (e.g. because of faulty material) such so that the nut stock is not driven out of the clamp into the die (that is when said nut stock 19 remains in the clamp and is brought back) the control circuit continues to receive a trigger signal and the machine stops immediately, indicating a defective punch. This safety mechanism will also avert the possibility of nut stock 19 being forced out of the clamp by another nut stock in the die when said nut stock 19 is being brought back to its original position. In this condition the punch would be impaired and the main slide would rotate. According to this invention, as the crank axis turns, electricity is turned on or off in different stages so that the machine stops running at once in case the conveyor system fails. When said system fails to operate normally in the stock-conveying stage from 0° to 92° power will be cut off immediately when no stock is being carried. Because of this, no trigger signal is transmitted and the machine stops running at once so as to prevent empty running and possible damage to the machine. In the event of a failure of the safety mechanism bringing about a power cut (e.g. in case of defective insulation 162 or the intrusion of foreign matter resulting an electrical connection between legs 15 and 16, the machine will still can stop immediately, because the circuit will remain closed at a time when no nut stock is supposed to have exited the clamp leg (e.g. at 181°–271°). It therefore can be seen that the present invention will prevent damage to the machine and the manufacture of defective products, as well as reduce labor requirements and raise productivity because of the efficient trouble-detecting and warning capabilities.

As the nut-stock conveyor 11 has to make 180° rotation and to and from movement it can only be connected with an unmoving part by a flexible spiral wire to not interfere with its movement. According to this invention, the flexible spiral wire 18 is used to connect the socket 183 an insulated fixture 182 attached to the body of the machine and the conductive stick 12. What is worth special attention is that power connection remains effective when the conveyor 11 rotates and moves.

Various changes may be made in the details of construction without departing from the spirit and scope of the invention as defined by the appended claims.

What is claimed is:

1. A multiphase forming machine having a clamp means including at least a pair of legs for grasping a workpiece during certain operating phases of the machine and a rotatable conveyor means for rotating and retaining said clamp means, an automatic safety mechanism for connection to a control circuit of the machine, said automatic safety mechanism comprising:

(a) means for electrically isolating one of said pair of legs from the other leg and from said conveyor means;

(b) an electrically conductive rod disposed inwardly of said conveyor means and in electrical isolation therefrom;

(c) a contact positioned on an end of said rod in electrical contact with said rod and said one of said pair of legs; and (d) a flexible electrically conductive member attached to the other end of said rod, wherein an electrical circuit is completed when an electrically conductive workpiece is grasped by said clamp means, said circuit including, in series, said machine, said conveyor means, said other of said legs, the grasped workpiece, said one of said legs, said contact, said rod and said flexible member, said electrical circuit being connected to said control circuit for sensing the pressure and non-pressure of said workpiece in said clamp means.

2. The mechanism of claim 1, further including means responsive to said circuit for stopping said machine when a workpiece is grasped by said legs at a time when no workpiece should be grasped and for stopping said machine when a workpiece is not grasped by said legs at a time when a workpiece should be grasped.

3. The mechanism of claim 1, wherein said isolating means comprises a layer of insulating material disposed between said one of said legs and said conveyor means, said layer effectively jacketing an end of said one of said legs.

4. The mechanism of claims 1, 2, or 3 wherein said flexible conductor comprises a spiral wire and wherein said spiral wire is at one end attached to a socket on an insulated fixture disposed on the body of said machine.

* * * * *